US005592277A

United States Patent [19]

Kusaka et al.

[11] Patent Number: 5,592,277

[45] Date of Patent: Jan. 7, 1997

[54] IMAGE FIXING APPARATUS AND IMAGE FORMING APPARATUS

[75] Inventors: Kensaku Kusaka, Kawasaki; Hidekazu Maruta, Yokohama; Koji Masuda, Kawasaki, all of Japan

[73] Assignee: Canon Kabushiki Kaisha, Tokyo, Japan

[21] Appl. No.: 391,231

[22] Filed: Feb. 21, 1995

[30] Foreign Application Priority Data

Feb. 21, 1994 [JP] Japan ..... 6-022611

[51] Int. Cl.[6] ..... G03G 15/20

[52] U.S. Cl. ..... 399/328; 399/67

[58] Field of Search ..... 355/203, 208, 355/282, 285, 289, 290

[56] References Cited

U.S. PATENT DOCUMENTS

| | | | |
|---|---|---|---|
| 4,634,262 | 1/1987 | Imaizumi et al. . | |
| 5,026,276 | 6/1991 | Hirabayashi et al. . | |
| 5,051,784 | 9/1991 | Yamamoto et al. | 355/285 |
| 5,084,738 | 1/1992 | Ishikawa | 355/285 |
| 5,115,278 | 5/1992 | Maruta et al. | 355/285 |
| 5,132,744 | 7/1992 | Maruta et al. | 355/282 |
| 5,148,226 | 9/1992 | Setoriyama et al. | 355/290 |
| 5,149,941 | 9/1992 | Hirabayashi et al. . | |
| 5,171,969 | 12/1992 | Nishimura et al. | 219/216 |
| 5,225,874 | 7/1993 | Koh et al. | 355/285 |
| 5,241,155 | 8/1993 | Koh et al. | 219/216 |
| 5,262,834 | 11/1993 | Kusaka et al. | 355/285 |
| 5,266,774 | 11/1993 | Kimura et al. . | |
| 5,365,314 | 11/1994 | Okuda et al. | 355/208 |
| 5,438,392 | 8/1995 | Okada | 355/285 X |
| 5,444,521 | 8/1995 | Tomoyuki et al. | 355/285 |

FOREIGN PATENT DOCUMENTS 0436955 7/1991 European Pat. Off. .

*Primary Examiner*—Sandra L. Brase
*Attorney, Agent, or Firm*—Fitzpatrick, Cella, Harper & Scinto

[57] ABSTRACT

An image forming apparatus includes an image forming device for forming an unfixed image on a recording material; a heater; and a film movable with the recording material carrying the unfixed image, the heater heats the unfixed image through the film and a control unit controls the fixing conditions in accordance with the thermal property of the film.

22 Claims, 6 Drawing Sheets

IMAGE FIXING APPARATUS AND IMAGE FORMING APPARATUS

FIELD OF THE INVENTION AND RELATED ART

The present invention relates to an image heating device for heating an image on a recording material, and more particularly to an image heating device suitable to a device for heating and fixing an unfixed developer image on the recording material. Particularly it relates to the image heating device wherein a film member is slid relative to a fixed heating member, and the recording material is close contacted to a surface of the film member opposite from the heating member side while moving through the heating position with the film member so that the heat energy is supplied to the recording material through the film member from the heating member.

Heretofore, as for the heat-fixing device for the unfixed image and/or an image heating device for executing improvement of a surface property of an image, a heat roller system has been widely used wherein the recording material supporting the image is nipped and transported by a heating roller and a pressing roller. However, in such a heat roller system the heat capacity of the heating roller is large, and therefore, there is a problem that the time (so-called warm up time) required for heating the heat roller up to a predetermined fixing temperature is long.

Under the circumstances U.S. Pat. No. 5,149,941, U.S. Ser. No. 444,802 or the like has proposed a film heating fixing device using a thermal head of the low heat capacity and a film of a small thickness sliding relative to the thermal head, thus reducing the warm up time. According to the fixing device, the electric energy consumption is also very low due to the reduction of the warm up time.

An example of such a fixing device is shown in FIG. 8.

When the recording material P carrying the unfixed toner image Ta entrances the nip formed between the pressing roller 209 and the heating member 200, the toner image Ta is heated by the heating member 200, and the sheet with the fixed toner image Tb is discharged from the nip. Includes, the support member 204 made from the resin material such as PPS is excellent to the heat insulation property, the heat resistivity, the rigidity supporting the heat generating member 202 and/or the base plate 201, the temperature sensing element 203 detecting the temperature of the heat generating member 202 substantially detects the temperature of the base plate 201, the protection layer 208 comprising or the like the glass is excellent to the durability protecting the heat generating member 202, "(" the thickness approx. 1 mm the ceramic base plate 201 such as the alumina is excellent to the thermal conductivity and the resistance heat generating member 202 of the resistance heat capacity such as the tungsten and/or the nickel-chrome the heating member 200. The film 205 moving in contact with the unfixed toner image comprises a resin material such as polyimide having a thickness of approx. 20–70 μm and having high heat resistivity, parting property, durability. The film 205 is stretched around a heating member 200 and a follow roller 207, a driving roller 206.

As described hereinbefore, the temperature sensing element 203 detects the heat transmitting toward the base plate 201 from the heat generating member 202. Electric power supply is controlled by unshown control means so that the detected temperature by the detection element 203 maintenances the predetermined temperature.

The heat generating member 202 heats the toner image through the protection layer 208 and the film 205.

It is difficult to manufacture always the very thin film with a predetermined thickness such as several tens μm, and among individual films, there is a variation of thickness of approx. ±60% at the maximum.

It has been found that the variation of the thickness brings about a slight variation in the fixing property. The film is very thin, but is of the resin material in order to assure the heat resistivity, the parting property and the durability, and it is difficult to say that it has a good thermal conductivity, and in addition it also has a heat insulation property. It has been found that when the use is made with a film thicker than a predetermined thickness, the heat the emitted from the heat generating member 202 and transmitting to the temperature sensing element 203 increases, the toner image is not sufficiently heated despite the fact that the control means controls the temperature to the predetermined temperature. On the contrary, when the use is made with a film thinner than the predetermined thickness, the heat insulation function is smaller than of the film of the predetermined thickness so that the heat transmission to the temperature sensing element 203 is smaller as compared with the case of the film of the predetermined thickness, and therefore excessive heating results.

SUMMARY OF THE INVENTION

An object of the invention is to provide an image forming apparatus and a fixing device providing a stable fixing property irrespective of a heat property of a fixing film.

Another object of the present invention is to provide an image forming apparatus having control means for controlling a fixing condition in response to a heat property of a fixing film.

A further object of the present invention is to provide a fixing device provided with storing means for storing a heat property of a fixing film.

A further object of the present invention is to provide a fixing condition setting method comprising a step of selecting a film in response to a thermal property of a fixing film and a step or setting the fixing condition in response to the fixing film selected.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The embodiments of the present invention will be described referring to FIGS. 1–7.

Figure 2:
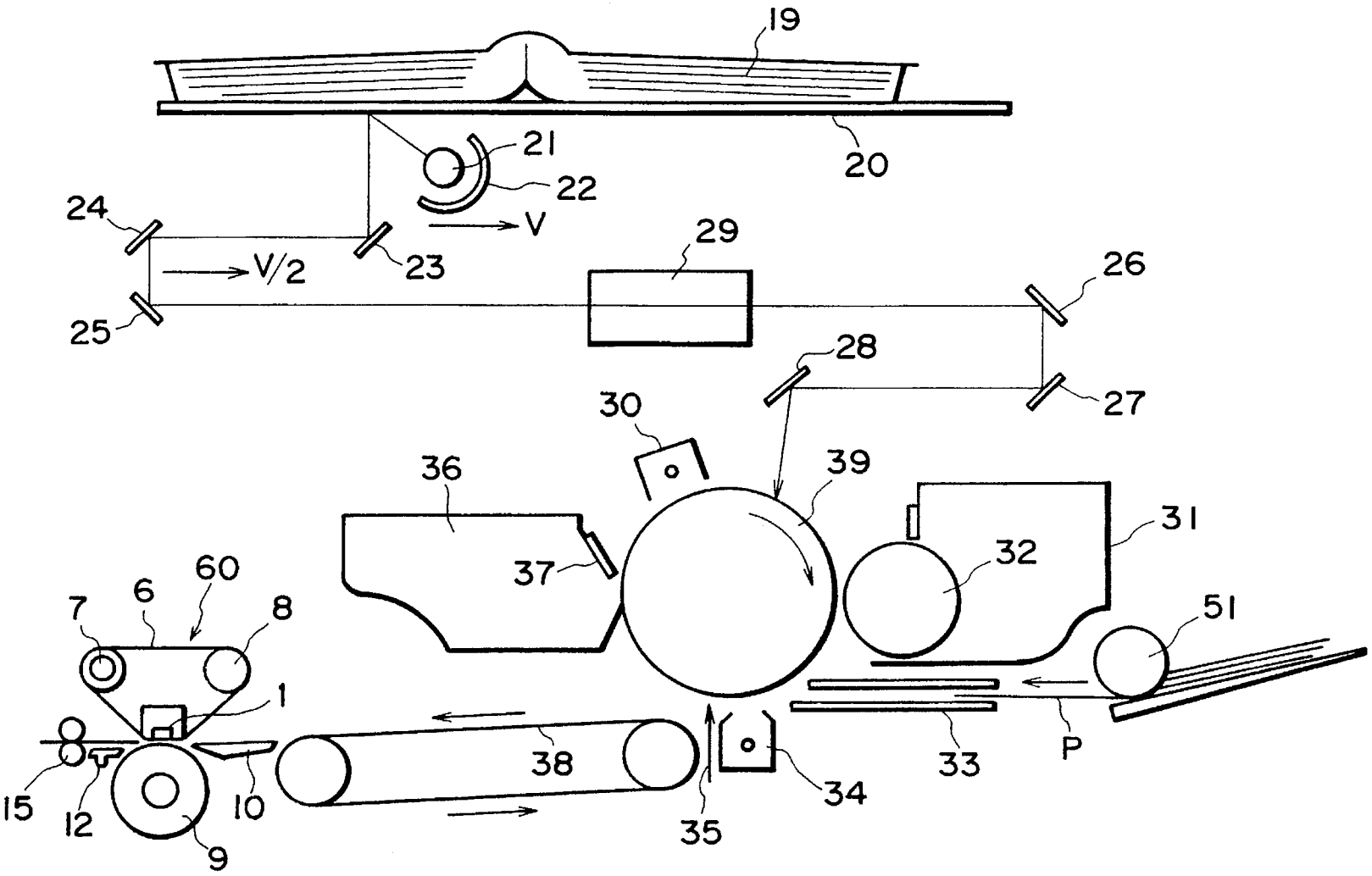
FIG. 2 is a schematic sectional view of an image forming apparatus incorporating the fixing device according to an embodiment of the present invention.

FIG. 2 shows an image forming apparatus using the present invention. As shown in FIG. 2, the exemplified image forming apparatus of the present invention is, an original carriage fixed type, an optical system moving type, a ratable drum type and an image transfer type electrophotographic copying machine.

In the device of FIG. 2, an original 19 is placed in a predetermined manner on a fixed original carriage glass 20, and predetermined copying conditions are set, and thereafter a copy start key is pushed then, a photosensitive member drum 39 is rotated at a predetermined peripheral speed in the clockwise direction indicated by an arrow. A reflection shade and a first mirror 23 is moved at a the predetermined speed V to the right-hand side of the glass from the home position at the left-hand side of the glass along surface the bottom surface of the original carriage glass 20, and a second mirror 24, a third mirror 25 are moved at the speed of V/2 in the same direction mirrors 26, 27, 28 sixth—fourth fixed and the imaging lens 29 through the rotating photosensitive drum 39 the surface of on (slit exposure) projected and imaged is the original reflected by the illumination scanning light, and right-hand side to left-hand side from the light source 21 and 22 by illuminated and scanned Is the original carriage glass 20 on placed the original 19 of the faced-down image surface, by this.

The surface of the rotatable photosensitive drum 39 has been charged uniformly to a positive or negative predetermined potential by a primary charger 30 before the image exposure, and the above-described exposure is effected to the charged surface, by which an electrostatic latent image of the pattern corresponding to the original image is formed sequentially on the surface of the drum 39. Is visualized as the toner image by the developing roller 32 of the developing device 31 the electrostatic latent image formed in the surface the photosensitive member drum 39.

On the other hand, a recording material P is fed by sheet feeding rollers 51, and is introduced to the transfer portion between the transfer charger 34 and the drum 39 at a predetermined timing through a guide 33, and receives transfer corona. It is contacted to the drum 39 so that the toner visualized image is transferred sequentially from the surface of the drum 39 to surface of the recording material.

The recording material P passing the image transfer portion is subjected to the discharging to remove the back surface charge by discharging needles 35, and is separated sequentially from the surface of the drum 39. And, it is introduced to a fixing device 60 through an inlet guide 10 and a transportation portion 38, and is subjected to toner image fixing operation which will be described hereinafter, and then it is discharged to an outside of the apparatus.

The surface of the drum 39 after the transfer operation is cleaned by a cleaning blade 37 of a cleaner 36 to remove contamination such as the residual toner, and is subjected to the image forming operation repeatedly.

When the movable optical member 21–25 having moved through the forward passage as described hereinbefore reaches the predetermined forward passage end portion, it moves through the backward passage to return to the original home position) the back process of the optical system the process, which will hereinafter be called (awaits up to the start of copy cycle the next.

Figure 3:
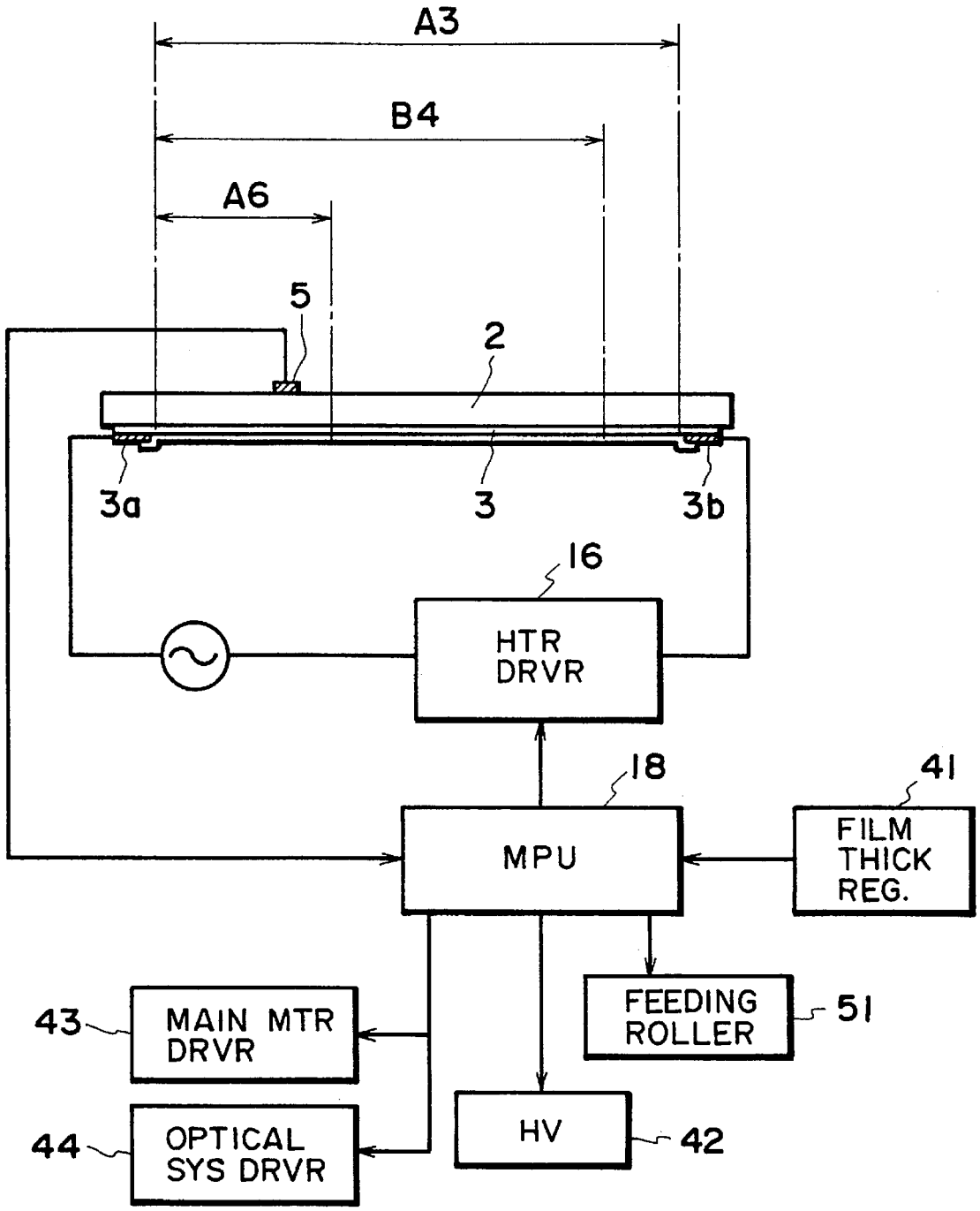
FIG. 3 is a block diagram of control means in embodiment 1 of the present invention.

In the case that a plurality of sheets (for example, 100 sheets) is set before the copy start key is depressed, the above-described process is repeated at the predetermined interval by a micro computer (in the following "MPU") 18 as indicated in FIG. 3, after the the completion of the back movement process of the optical system.

Figure 1:
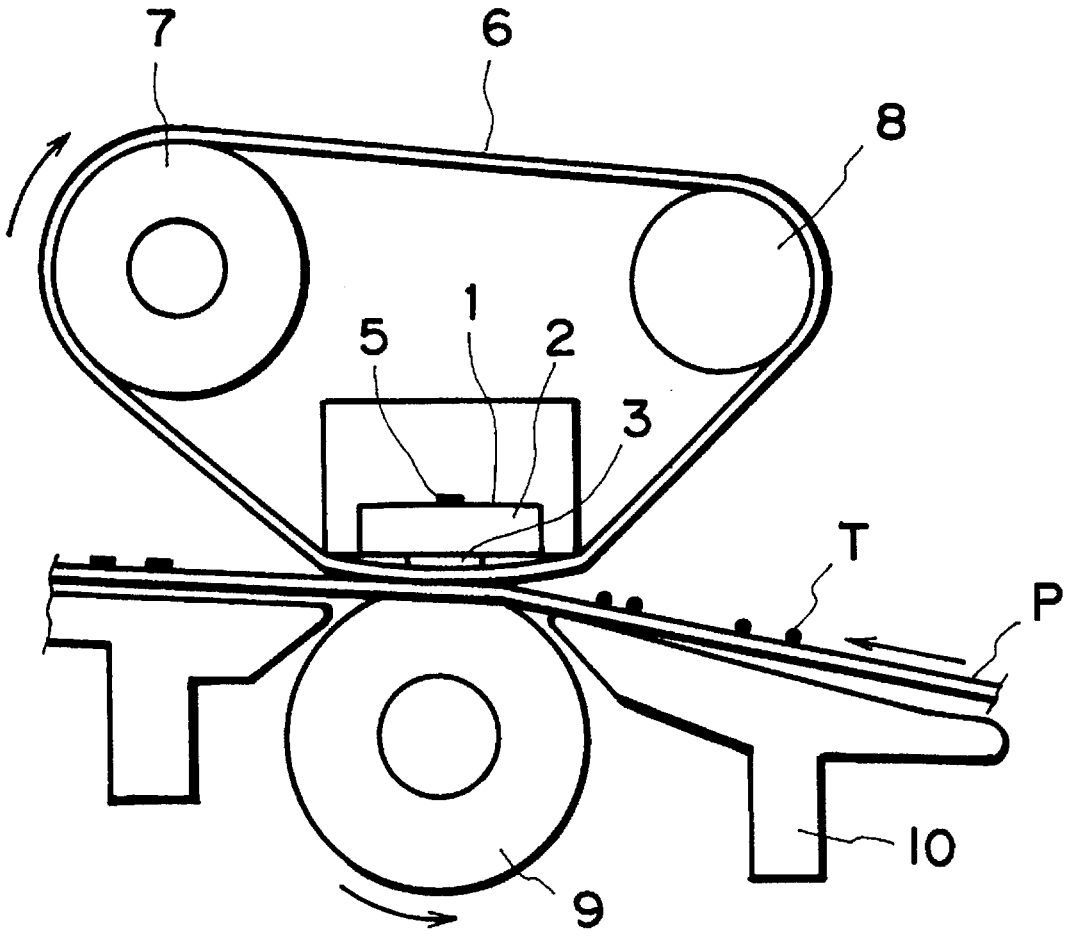
FIG. 1 is a schematic sectional view of a fixing device according to an embodiment 5 of the present invention.

Referring to FIG. 1, detailed description will be made as to the fixing device 60 mounted to the present embodiment apparatus.

FIG. 1 is an enlarged sectional view of the fixing device 60. In FIG. 1, a heating member 1 is provided with a heat generating member 3 of linear shape having a low heat capacity, and a resistance material 3 such as silver palladium is coated with a width of 1.0 mm on an alumina base plate 2 having a the length of 350 mm, a width of 10 mm and a thickness of 1.0 mm, for example, it is supplied with electric energy at longitudinal opposite ends of the fixing device. The electric power supply is controlled by control means (not shown) including a micro computer, so that a detected temperature of a temperature sensing element 5 such as a thermister in contact with the surface opposite from the base plate surface supporting the heat generating member 3, is kept at a predetermined target temperature. **3*a*, 3*b* shown in FIG. 3 are the opposite ends of the resistance material 3**.

The fixing film 6 moves in the direction of the arrow in contact to the heating member 1 which is under the temperature control in such a manner.

The fixing film 6 is a heat resistive film having a thickness approx. Of 20 μm, and is an endless film having a base layer comprising the material such as polyimide, polyetherimide, PES or PFA and a parting layer, coated thereon, and comprising fluorine resin material such as PFA or PTFE added with an electroconductive material. The parting layer is contactable to the toner image. Generally the film total thickness is less than 100 μm to assure proper heat conduction, and more preferably, less than 40 μm. The fixing film 6 is stretched by the heating member 1, a follow roller 8 and a driving roller 7 so that it moves without creases in the direction of the arrow even if the driving roller 7 is rotated.

Press-contact rotates and the film 6, and press the heating member 1 through the fixing film 6 by the total pressure of 6–12 kg, by the pressing roller having the rubber elastic layer having a good parting property such as the silicone rubber 9.

The recording material P carrying the unfixed toner T is guided to the fixing portion by the inlet guide 10.

In this embodiment, the film 6, the pressing roller 9, the follow roller 8, the driving roller 7 and the heating member 1 are in the form of a unit detachably mountable relative to the main assembly of the image forming apparatus, but only the film 6, the roller 7, 8 and the heating member 1 may constitute the unit.

Figure 4:
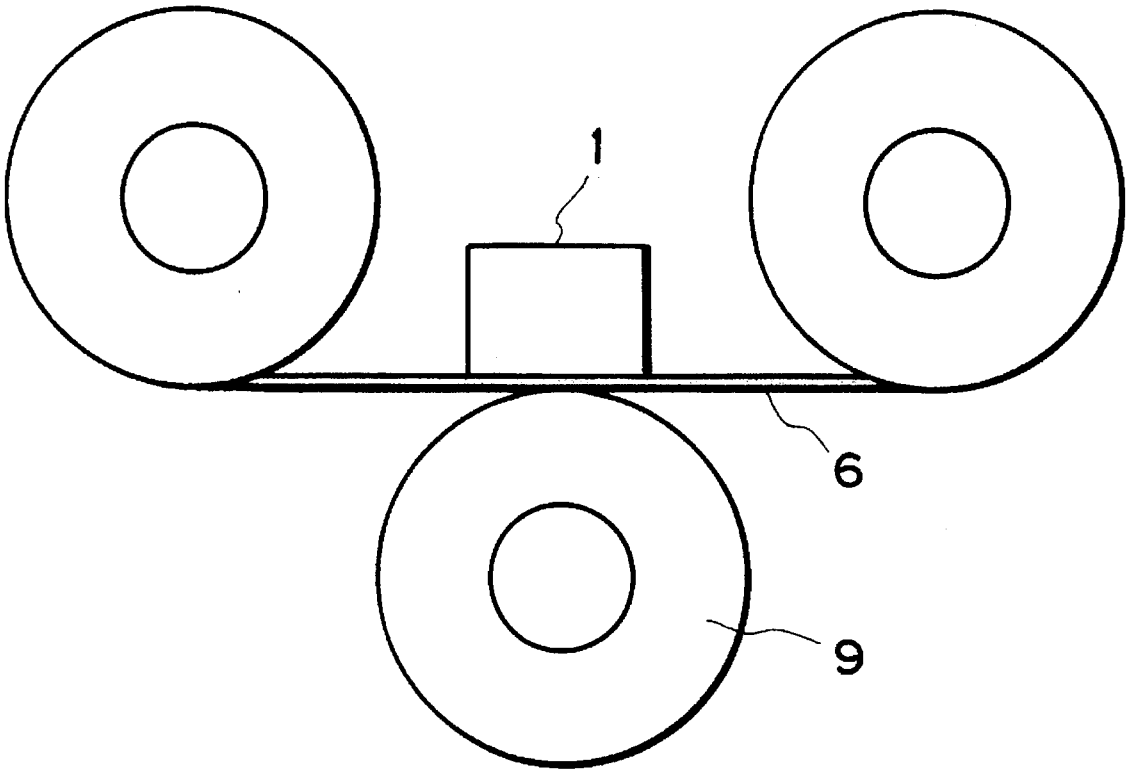
FIG. 4 is a schematic sectional view of the fixing device of another example of the present invention.

In the embodiment of FIG. 2, the fixing film 6 is in the form of an endless belt, but may be a non-endless film as shown in FIG. 4.

Figure 5:
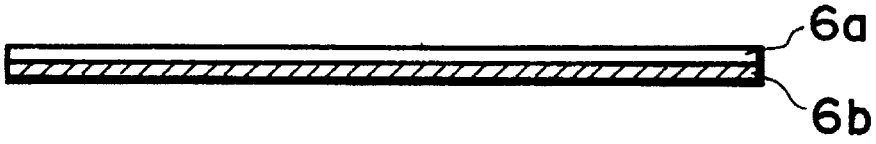
FIG. 5 is a sectional view of a fixing film according to an embodiment of the present invention.

FIG. 5 is a sectional view of the fixing film 6. The base layer **6*a* is slidable relative to the heating member 1, and the parting layer 6*b*** is in contact with the recording material P.

In this embodiment, the use is made with a polyimide film as the base layer **6*a*, and a carbon black dispersed semioconductive PFA coating film as the parting layer 6b. The predetermined value of the thickness of ta of the base layer 6a is 20 μm, but it is 20 μm±10 μm in view of the error during the manufacturing. The thickness of tb of the parting layer 6b is 15 μm±10 μm relative to a predetermined value 15 μm. Therefore, relative to a predetermined value 35 μm of the total thickness, the actual manufactured film involves a variation in the range of 35 μm±20 μm. At least one of ta, tb and ta+tb (ta+tb=t) is measured in the production line before the assembly of the fixing device, and is stored in a film thickness register 41 (storing means) such as ROM mounted to the fixing device 60** which is mountable to the main assembly of the image forming apparatus as the unit. On the basis of the stored information the power supply of the control means for the main assembly of the image forming apparatus is controlled. At least one of the pieces of information ta, tb, ta+tb with respect to the fixing film thickness may be registered in the MPU18 per se of the image forming apparatus. Material the recording for recording the fixing film thickness and mounted to the fixing device is not limited to ROM but may be a dip switch and/or a variable resistance. The fixing film thickness is measured actually using a micro-meter or the like, but in addition to the method, for example, while rotating the fixing film, after assembling the fixing device, the heat generating member is supplied with electric energy, and the rising of the fixing film surface temperature is measured, and the fixing film thickness may be predicted.

Following table 1 gives the control temperature for the heating member in this embodiment. As will be understood, the control temperature is changed in accordance with the total thickness of the fixing film. More particularly, if the fixing film is thin the control temperature is low, and if the fixing film is thick the control temperature is high.

In addition, in consideration of the temperature rise of the pressing roller and/or the film by the continuous copy operation, the target temperature is switched in response to the number of the continuous copy sheets. More particularly, the target temperature is lowered in accordance with the continuous copy operation.

TABLE 1

| Total thick. | Control Temp. | | |
|---|---|---|---|
| t(μm) | 1st | 2–9th | 10- |
| 15 ≦ t < 20 | 190° C. | 180° C. | 170° C. |
| 20 ≦ t < 25 | 200° C. | 190° C. | 180° C. |
| 25 ≦ t < 30 | 210° C. | 190° C. | 180° C. |
| 30 ≦ t < 35 | 210° C. | 200° C. | 180° C. |
| 35 ≦ t < 40 | 220° C. | 200° C. | 180° C. |
| 40 ≦ t < 55 | 230° C. | 210° C. | 190° C. |

By the use of such a temperature control system, even if there is a variation within the thickness tolerance of the fixing film, the fixing defect and/or the offset does not occur.

COMPARISON EXAMPLE

The temperature control was executed with 110° C. for the first, 190° C. for 2–9th, 180° C. for after the 10-th sheet 10, irrespective of the thickness of the fixing film. In the case that the fixing film is thick the fixing defect occurs at the first sheet, and in the case that the fixing film is thin the high temperature offset occurs after the 10-th sheet.

In an embodiment 1, in the case that the thermal property (the thickness of the film, for example,) of one layer of the two layers constituting the fixing film is decisive for the fixing property, the control temperature may be determined in accordance with the thickness of the particular layer not of the total thickness of the fixing film.

As to the thermal property of the film stored in the storing means such as the dip switch and/or ROM, it is not limited to the thickness of the film but may be a thermal conductivity. For example, in another alternative, in the case that the thermal conductivity of the parting layer 6b depends on the content of the dispersed carbon, the electric resistance of the parting layer 6b is measured, and the value of the electric resistance is recorded in the storing means of the fixing device or in the MPU of the main assembly, and the control temperature may be adjusted in accordance with the value.

EMBODIMENT 2

Figure 6:
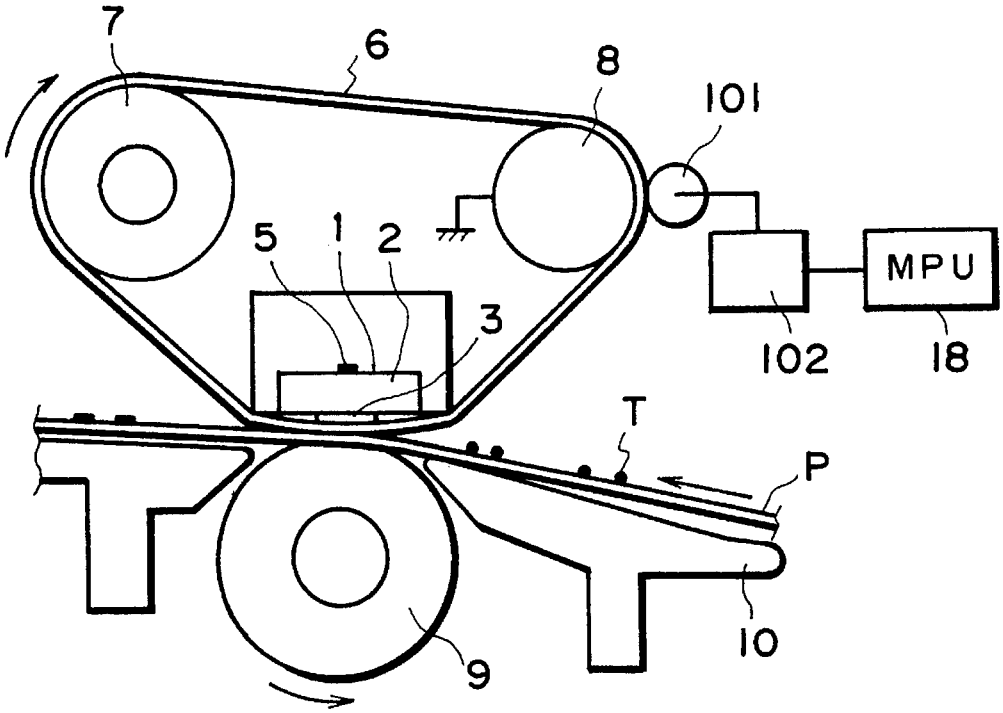
FIG. 6 is a schematic sectional view of a fixing device of embodiment 2 of the present invention.

Referring to FIG. 6, embodiment 2 of the present invention will be described. According to the present embodiment, even if the thickness of the fixing film decreases by the sliding with the recording material and/or the heating member, the heating operation can be always most preferable. In addition, in the case of the use over a long period, if the method of the present embodiment is incorporated, the control temperature can be gradually lowered, and therefore the long lifetime of the device can be also expected.

EMBODIMENT 3

Figure 7:
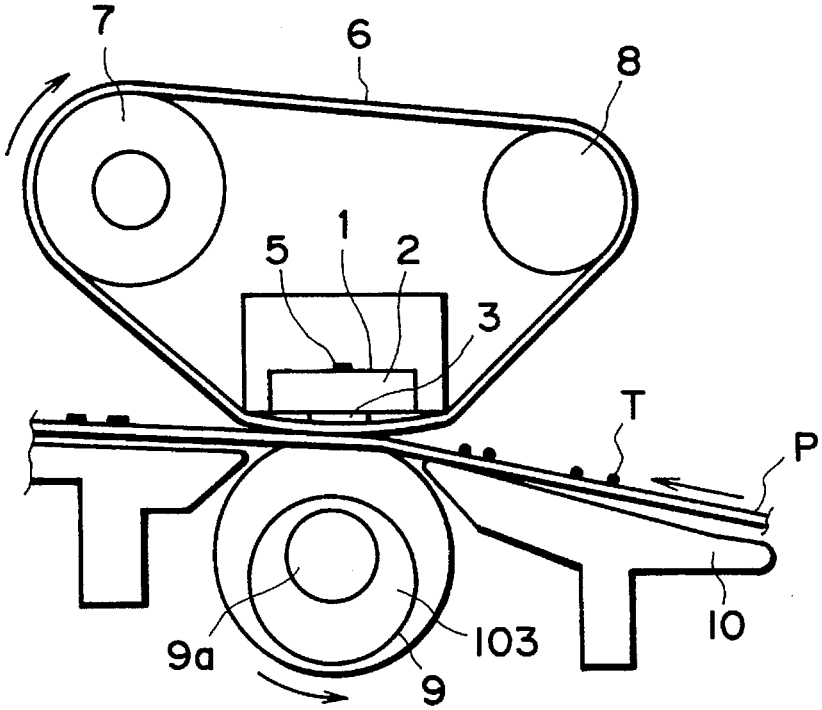
FIG. 7 is a schematic sectional view of a fixing device of embodiment 3 of the present invention.
Figure 8:
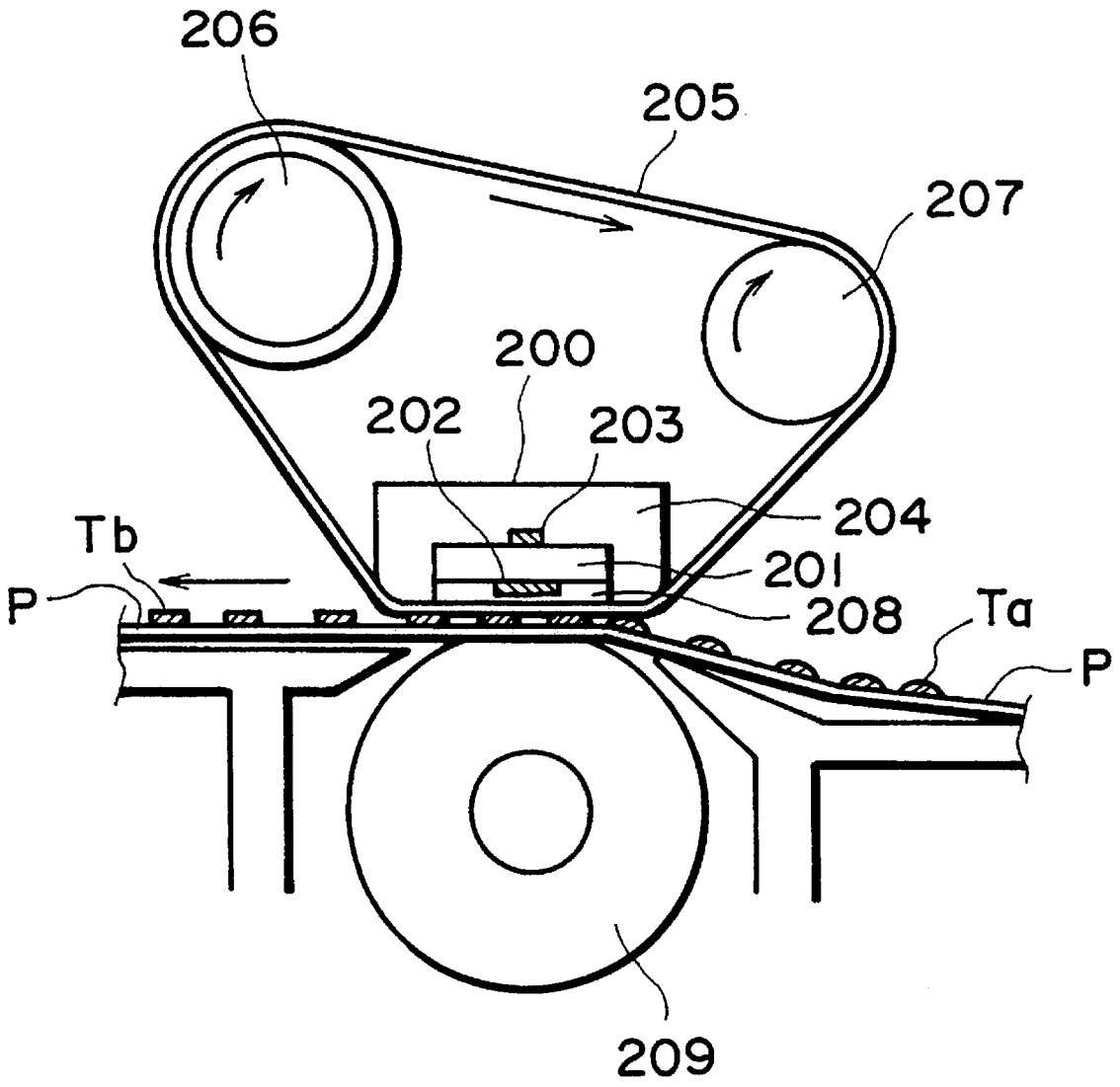
FIG. 8 is a sectional view of a fixing device illustrating an operation of a fixing device using a film.

Referring to FIG. 7, an embodiment 3 will be described. The major portion of the structure of the present embodiment is similar to embodiment 1, but the shaft 9a, of the pressing roller 9 is supported by an eccentric bearing 103. The bearing 103 is rotatable while the recording material is not contacted with the pressing roller 9 by an unshown stepping motor, and by a predetermined degree rotation of the stepping motor, the urging force of the pressing roller 9 to the heating member 1 is adjustable.

In this embodiment, the above-described urging force is changed as given in the following table 2 in accordance with the thickness of the fixing film. Pressing force is lowered with the decrease of the thickness of the fixing film, and pressing force is raised with the increase of the thickness of the fixing film. In addition, the temperature control condition follows table 1.

TABLE 2

| Total thick. | Pressing Force | | |
|---|---|---|---|
| t(μm) | 1st | 2–9th | 10- |
| t < 20 | 8 kg · f | 8 kg · f | 6 kg · f |
| 20 ≦ t < 30 | 10 kg · f | 8 kg · f | 8 kg · f |
| 30 ≦ t < 40 | 10 kg · f | 10 kg · f | 8 kg · f |
| 40 < t | 12 kg · f | 12 kg · f | 10 kg · f |

According to the present embodiment, the fixing property in the case that the fixing film is thick is further improved, and in addition, the pressing force can be reduced without damaging the fixing property, and therefore, the durability in the case that the fixing film is thin is improved.

EMBODIMENT 4

Embodiment 4 of the present invention will be described. The major portion of the structure of the present embodiment is similar to embodiment 1, but in accordance with the thickness of the fixing film, the driving of the optical system motor driving circuit 44, the driving of the sheet feeding roller 51 and the driving of the high voltage voltage source 42 are delayed through a predetermined period of time (the wait time) by the MPU18. During this, the heating member is energized by a heating member driving circuit 16 to effect preliminary heating . Also during this, the main motor is rotated by the main motor driving circuit 43, and the fixing film slides on the heating member and is heated thereby.

The following table 3 gives the control temperature and the wait time relative to the thickness of the fixing film.

TABLE 3

| Total thick. | Pressing Force | | | |
|---|---|---|---|---|
| t(μm) | 1st | 2–9th | | 10- |
| 15 ≦ t < 20 | 0 | 190 | 180 | 170 |
| 20 ≦ t < 25 | 0 | 200 | 190 | 180 |
| 25 ≦ t < 30 | 0 | 210 | 190 | 180 |
| 30 ≦ t < 35 | 0 | 210 | 200 | 180 |
| 35 ≦ t < 40 | 5 | 210 | 200 | 180 |
| 40 ≦ t < 55 | 10 | 210 | 210 | 190 |

The present embodiment is effective to reduce the maximum temperature of the heat generating member in the case that the thick fixing film is incorporated, and, as a result excessive rise of the heat generating member temperature in the nonk-sheet processing area upon the small size sheet processing can be prevented. On the other hand, in the case that the fixing film having the normal thickness is incorporated, the wait time for the fixing is not produced to avoid the inconvenience to the user.

EMBODIMENT 5

Embodiment 5 of the present invention will be described. The major portion of the structure of the present embodiment is similar to embodiment 1, but when the thickness of the fixing film is small, the maximum electric power is reduced as compared with the case that it is thick.

According to this embodiment, even if the heat capacity of the fixing device is small, the temperature ripple of the heat generating member can be suppressed.

EMBODIMENT 6

Embodiment 6 of the present invention will be described. The major portion of the structure of the present embodiment is similar to embodiment 1, but the film transportation speed namely, the fixing speed is increased or decreased in response to the thickness of the fixing film.

According to the present embodiment, even in the case of the fixing film of a different thickness, the equivalent proper fixing property is provided without changing the control temperature, and the toner offset can be prevented.

In the above-described embodiment, the thermal property of the film is stored in the fixing unit, and the stored information is detected by the main assembly of the image forming apparatus, and the main assembly of the image forming apparatus automatically switches the fixing condition. However, the film may be selected for each the thermal property of the film in the film production process to permit manual setting of the fixing condition in accordance with the thermal property of the film. For example, the film is selected in accordance with the thermal property in the production line beforehand so that the serviceman can discriminate the difference of the film when the film per se is exchanged in the image forming apparatus. The serviceman may set manually the fixing condition of fixing device.

As described in the foregoing, according to the present invention, by changing the fixing condition in response to the thermal property such as the thickness of the fixing film, the always proper fixing property is provided even if the fixing film of a different thickness is incorporated, and the offset is not produced. In addition, the thickness of the usable fixing film and/or the tolerance of the material property can be large, and therefore the yield on the manufacturing of the fixing film is improved. The cost reduction of the device per se can be also expected.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an unfixed image on a recording material a heater;

a film movable with the recording material carrying the unfixed image, wherein said heater heats the unfixed image through said film;

a control means for controlling a fixing condition in accordance with a thickness of said film.

2. An apparatus according to claim 1, wherein said film comprises a plurality of laminated layers, and the thickness of said film is a thickness of at least one layer of said plurality of layers.

3. An apparatus according to claim 1, further comprising a temperature detector for detecting a temperature of said heater, wherein said control means controls electric power supply to said heater so that said detector detects a temperature which is higher if the thickness of said film is larger.

4. An apparatus according to claim 1, further comprising a pressing roller for urging the recording material toward said heater and pressing force switching means for switching pressing force of said pressing roller relative to said heater, wherein said control means controls said pressing force switching means so that the pressing force of a pressing roller relative to said heater increases the with increase of the thickness of said film.

5. An apparatus according to claim 1, wherein said control means switches, in response to the thickness of said film, a preliminary heating period after start of electric power supply to said heater until start of heating of the unfixed image.

6. An apparatus according to claim 1, wherein said control means switches, in response to the thickness of said film, a maximum supply of electric power to said heater.

7. An apparatus according to claim 1, wherein said control means switches, in response to the thickness of said film, a fixing speed.

8. An apparatus according to 1, further comprising discrimination means for discriminating the thickness of said film.

9. An image forming apparatus comprising:

image forming means for forming an unfixed image on a recording material;

a heater;

a film movable with the recording material carrying the unfixed image, wherein said heater heats the unfixed image through said film; and control means for controlling a fixing condition in accordance with a thermal conductivity of said film.

10. An apparatus according to claim 9, wherein said film contains carbon, and wherein a thermal conductivity of said film is different depending on a content of the carbon.

11. A fixing device comprising:

a heater;

a film movable with a recording material carrying an unfixed image wherein said heater heats the unfixed image through said film; and storing means for storing a thermal property of said film.

12. An apparatus according to claim 11, wherein the thermal property of said film is a thickness of said film.

13. An apparatus according to claim 12, wherein said film comprises a plurality of laminated layers, and the thickness of said film is a thickness of at least one layer of said plurality of layers.

14. An apparatus according to claim 11, wherein a thermal property of said film is a thermal conductivity of said film.

15. An apparatus according to claim 14, wherein said film contains carbon, wherein a thermal conductivity of said film is different depending on a content of the carbon.

16. An apparatus according to claim 11, wherein said storing mean includes a ROM.

17. An apparatus according to claim 11, wherein said storing means includes a vairable resister having a resistance switchable in accordance with the thermal property of said film.

18. An apparatus according to claim 11, wherein said storing means includes a dip switch switchable in accordance with the thermal property of said film.

19. An apparatus according to claim 11, wherein said fixing apparatus is detechably mountable to a main assembly of an image forming apparatus for forming an unfixed image on a recording material.

20. An image fixing condition setting method, comprising:

discriminating a thermal property of the film for a fixing device; and setting a fixing condition of the fixing device in accordance with the thermal property.

21. A method according to claim 20, further comprising the steps of: detecting thermal properties of a plurality of films before said discriminating step; and classifying the plurality of films on the basis of the thermal properties obtained by the detecting step.

22. An image fixing condition setting method, comprising the steps of:

discriminating a thickness of a film for a fixing device;

setting a fixing condition of the fixing device in accordance with the thickness.

* * * * *

UNITED STATES PATENT AND TRADEMARK OFFICE

CERTIFICATE OF CORRECTION

PATENT NO. : 5,592,277 
DATED : January 7, 1997
INVENTOR(S) : Kansaku KUSAKA, et al.

It is certified that error appears in the above-indentified patent and that said Letters Patent is hereby corrected as shown below:

On the Cover Page, ABSTRACT, item [57]
Line 4, "image, the" should read --image. The--.

COLUMN 1
Line 38, "entrances" should read --enters--;
Line 66, "mainte-" should read --main---;
Line 67, "nances" should read --tains--.

COLUMN 2
Line 3, "always" should be deleted;
Line 14, "the" (second occurrance) should be deleted;
Line 15, "transmitting" should read --transmittted--
Line 43, "or" should read --of--.

COLUMN 3
Line 12, "is," should read --is--;
Line 20, "pushed then," should read --pushed, then--;
Line 52, "to" should read --to the--;
Line 60, "to an outside of" should read --from--.

COLUMN 4
Line 8, "the" should be deleted;
Line 9, "interval" should read --intervals--;
Line 20, "the" should be deleted;
Line 34, "approx. Of" should read --of approx.--;
Line 36, "and" (second occurance) should be deleted;
Line 57, "roller" should read --rollers";
Line 66, "the" should read --of--, and "with" should read --of--.

UNITED STATES PATENT AND TRADEMARK OFFICE

CERTIFICATE OF CORRECTION

PATENT NO. : 5,592,277

DATED : January 7, 1997

INVENTOR(S) : Kansaku KUSAKA, et al.

It is certified that error appears in the above-indentified patent and that said Letters Patent is hereby corrected as shown below:

COLUMN 5

Line 45, in Table 1, "10-" should read "10+";

Line 51, in Table 1, "<55" should read --≤55--;

Line 59, "10-th" should read --10th--;

Line 60, "10" should be deleted;

Line 63, "10-th" should read --10th--;

Line 65, "an" should be deleted.

COLUMN 6

Line 2, "layer" should read --layer,--

Line 38, "table" should read --Table--;

Line 43, "table" should read --Table--;

Line 49, in Table 2, "10-" should read --10+--.

COLUMN 7

Line 3, "this," should read --this time,--;

Line 14, in Table 3, "10-" should read --10+--;

Line 20, in Table 3, "<55" should read --≤55--.

COLUMN 8

Line 18, "material" should read --material;--;

Line 22, "film;" should read --film; and--;

Line 40, "the with" should read --with the--.

--

UNITED STATES PATENT AND TRADEMARK OFFICE

CERTIFICATE OF CORRECTION

PATENT NO. : 5,592,277
DATED : January 7, 1997
INVENTOR(S) : Kansaku KUSAKA, et al.

It is certified that error appears in the above-indentified patent and that said Letters Patent is hereby corrected as shown below:

COLUMN 9

Line 21, "vairable" should read --variable--.

Signed and Sealed this

Fifteenth Day of July, 1997

Bruce Lehman

*Attest:*

BRUCE LEHMAN

*Attesting Officer*

*Commissioner of Patents and Trademarks*